United States Patent [19]

Geldwerth et al.

[11] 4,170,809

[45] Oct. 16, 1979

[54] AXIAL JEWELRY CLASP

[75] Inventors: Simon Geldwerth; Mendek Rubin, both of Brooklyn, N.Y.

[73] Assignee: Do-All Jewelry Mfg. Co., Inc., Brooklyn, N.Y.

[21] Appl. No.: 870,352

[22] Filed: Jan. 18, 1978

[51] Int. Cl.[2] ..... A44B 11/25

[52] U.S. Cl. ..... 24/230 R; 24/223

[58] Field of Search ..... 24/230 R, 230 BC, 230 AL, 24/201 HE, 73 J, 223

[56] References Cited

U.S. PATENT DOCUMENTS

| | | | |
|---|---|---|---|
| 833,458 | 10/1906 | Hausherr | 24/230 R |
| 1,193,330 | 8/1916 | Wray | 24/230 R |
| 3,543,356 | 12/1970 | Zimmermann | 24/230 R |

FOREIGN PATENT DOCUMENTS

| | | | |
|---|---|---|---|
| 144427 | 6/1920 | United Kingdom | 24/230 R |

*Primary Examiner*—Kenneth J. Dorner

[57] ABSTRACT

A jewelry clasp for a slender, elongated, band—e.g., a necklace, bracelet or the like—comprises male and female members respectively attachable to the band terminals; the female member being tubular and the male member having a detent with a projecting tongue and with a spring leaf, constituted by a distal extension thereof, folded to overlie the tongue in angular relation therewith; being deflectible to lie flatly against the tongue to permit its passage through a narrow diametrical slot in an end closure of the female member; said leaf then rising off the tongue in the interior of the female member to engage the inner face of the end closure preventing withdrawal of the male member therefrom and also becoming wedged against the progressively narrowing inner walls of the female member to inhibit wobbling of the male member therein; a fin projecting through a slot in the wall of the female member being manipulable to depress the leaf to permit withdrawal of the detent from the female member.

8 Claims, 6 Drawing Figures

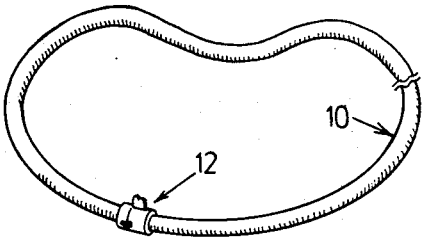
FIG.1.
FIG.2.
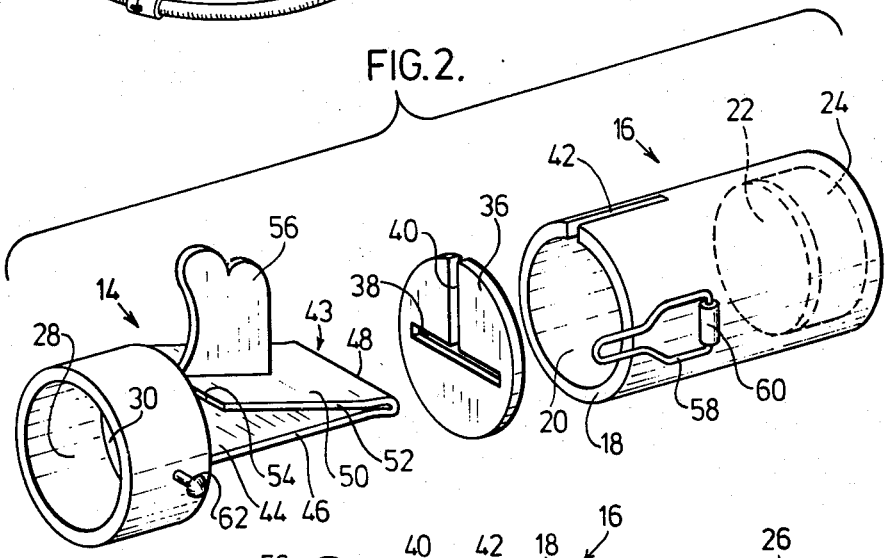
FIG.3.
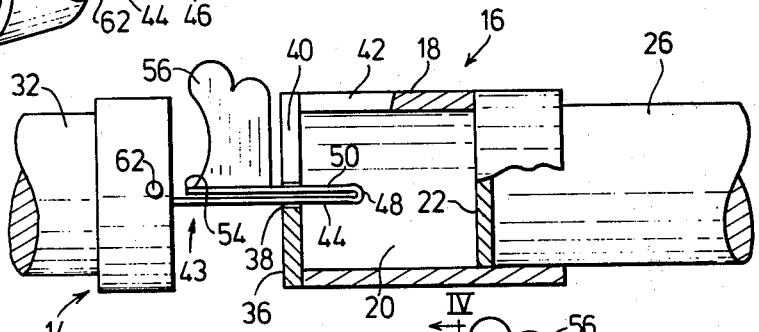
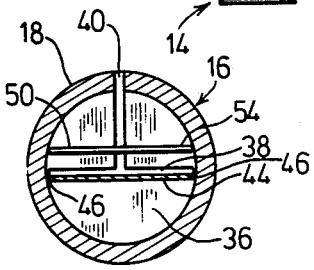
FIG.4.
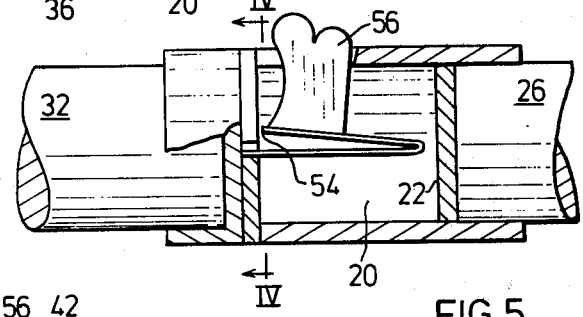
FIG.5.
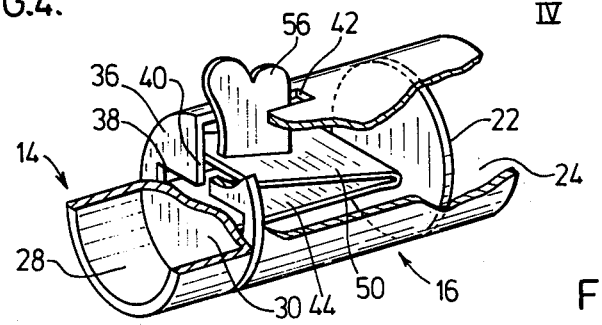
FIG.6.

AXIAL JEWELRY CLASP

The invention relates to jewelry clasps for (Jewelry) bands which are intended to be looped and fastened around the wrist or neck, for example, of a wearer.

The clasp under present consideration comprises male and female members which are respectively attachable to the band terminals; the male member being telescopically receivable and releasably capturable within the female member to interlock the two.

In jewelry, aesthetic features constitute major considerations in view of which a clasp associated with a piece of jewelry is fashioned, ordinarily, to assume an integral indentification with the jewelry. That is to say, if the clasp is to be attached to jewelry which is thin and broad—e.g.: strap-like—, the clasp members will have conforming cross-sectional conformations and proportions. In the present instance, the invention is addressed to jewelry bands having slender terminals with more or less equal cross-sectional dimensions in several directions—e.g.: square, triangular, cylindrical, elliptical, or the like. The clasp has, accordingly, to be of relatively small girth although it may be, and preferably is, elongated.

It will be appreciated that jewelry as herein contemplated is often fine and expensive and, for that reason, secure interlock of the male member with its female counterpart is essential to ensure that, unless and until deliberately released, these members will remain interlocked despite the stresses applied thereto by the normal movements of the wearer.

In the prior art, it is known to provide jewelry clasps comprised of a hollow female member penetrable through a slotted wall and a male member with a projecting detent which is collapsible to penetrate the female member through the slotted wall and thereafter re-expandible inside the female member to engage the slotted wall on its interior and thereby prevent disassembly of the members; means being provided, of course, for re-collapsing the detent by external manipulation when it is desired to separate the two members.

It will be understood that the resistance to stress in a clasp of this type ordinarily increases proportionately to the dimension of the engagement between the detent and the female member. Thus, if the clasp is to be attached to jewelry which is broad, the area of engagement may be spread out proportionately widely and hence be relatively large. Conversely, in a slender clasp as contemplated by the present invention, the corresponding engagement can only be relatively small and special measures are, accordingly, required to endow the clasp with the security requisite for protecting the jewelry.

In particular, the invention recognizes that a loose engagement of the male and female members is detrimental to security since it permits the parts to wobble relative to each other and, thereby, to work themselves free from each other.

It is, accordingly, a principal object of the invention to provide a clasp of relatively narrow girth comprised of a female member and a male member which is releasably capturable within the female member and relatively firmly retained and restrained against excessive wobbling therein.

More specifically, the invention seeks to provide a clasp as described comprised of a hollow female member which is penetrable through a slotted wall and a male member having a resilient detent which is collapsible to penetrate the female member through the slotted wall and re-expandible in the interior of the female member to engage the wall in the interior of the female member and thereby retain the members in assembly; said detent also engaging the side walls of the female member to inhibit—if not totally prevent—wobbling of the members relative to each other when they are interlocked.

Other objects of the invention will become apparent as the description herein proceeds.

As known in the prior art, the present clasp is comprised broadly of a tubular female member having a socket for a band terminal at one of its ends and a thin closure—e.g., a wall—at its other end with a slot in said closure transversely straddling the female member. In addition, it includes a male member with a socket for a band terminal and with an axially extending detent including an angular leaf spring which is deflectible to permit penetration of the detent through the closure slot of the female member and which is biased to re-expand thereafter in the interior of the female member to engage the inner face of the end closure and thereby prevent withdrawal of the male member therefrom; means being also provided for manipulation externally of the female member to re-compress the detent in the interior of the female member to permit separation of the clasp members.

Unlike the prior art, however, the slot in the end closure of the present female member straddles one of its widest internal cross-sections, with which the width of the detent is commensurate; the internal width of the female member narrowing thereafter progressively in at least one direction which is oriented angularly to the direction of the slot.

Thus, when the detent has penetrated through the end closure and begins to re-expand, the expansive force will cause it to become wedged between the narrowing side walls of the female member. Combined with its withdrawal resistance consequent upon the engagement of the detent with the end closure, the wedging of the detent between the walls of the female member as described will therefore substantially increase the retainability of the male member within the female member not in the least by inhibiting wobbling as described.

In greater detail, the detent consists of a tongue which projects axially from the front of the socket portion of the male member and which has an integral distal extension folded back to overlie the tongue and biased to assume a normal posture angular to the tongue; said extension constituting a spring leaf which is deflectible to lie flatly against the tongue and in registration therewith to permit conjoint insertion of both of them through the slot into the female member; the leaf being shorter than the tongue by the thickness of the closure to permit it to rise in the interior of the female member after penetration. Upon rising, said leaf will wedge itself between the narrowing walls of the female member while its free edge engages the inner face of the closure all as heretofore described to inhibit wobbling and increase the security of the interlock between male and female members.

The detent deflecting means of a clasp in accordance with this invention is usefully in the form of a fin upstanding on the leaf of the male clasp member; such fin projecting outwardly through appropriately oriented and aligned passageways in the peripheral walls and end closure of the female clasp member whereby on deflection of said fin, said leaf is flattened against said tongue for conjoint movement therewith through the slot in said end closure of said female clasp member and through the passageways aforesaid.

Other features of the invention and the advantages presented thereby will become apparent as the description herein proceeds.

The invention will now be described merely by way of illustration with reference to the accompanying drawings, in which:

FIG. 1 is a perspective view of a jewelry band provided with a clasp in accordance with this invention;

FIG. 2 is an exploded perspective view of the clasp shown in FIG. 1;

FIG. 3 is an axial sectional view through the clasp shown in the preceding figures showing the male clasp member partly inserted into a female clasp member;

FIG. 4 is a section along the line IV—IV of FIG. 5;

FIG. 5 is an axial sectional view similar to that of FIG. 3 but showing the male clasp member fully inserted into the female clasp member;

FIG. 6 is a fragmentary perspective view through the clasp shown in FIG. 5 with certain parts cut away to reveal the internal inter-engagement of the male and female clasp members.

There is shown generally at 10 in FIG. 1 a band or bracelet provided with a clasp generally indicated at 12 in accordance with the teaching of this invention. The clasp 12 comprises a male clasp member generally indicated at 14 and a female clasp member generally indicated at 16; each having sockets for slender terminals. Since the structure of the band 10, in itself, forms no part of this invention, it will not be described in greater detail herein.

Referring now to the female clasp member 16, it will be seen that it comprises a tubular body having peripheral walls 18 enclosing, in part, an internal compartment indicated at 20. In the particular embodiment shown in the accompanying drawings, the compartment 20 has a generally right cylindrical configuration.

A radially extending web 22 intermediate the ends of female clasp member 16 partitions it and separates its compartment 20 from a socket 24 for receiving one terminal 26 of the band 10. Similarly, the male clasp member 14 comprises a socket 28 having a wall 30 at one end of an enclosing cylindrical sleeve providing the socket for the other terminal 32 of band 10. The sockets 24 and 28 conform in shape to the slender band terminals which are secured thereto in any appropriate manner; for example, by soldering.

Returning now to the female clasp member 16, it will be seen that the end of the compartment 20 opposite web 22 is closed by an end closure 36. A diametrically extending slot 38 is provided in the closure 36 and, as will readily be understood by reference to FIG. 4, that slot 38 extends and straddles, in the illustrated embodiment, essentially the full width of the compartment 20. A second opening or slot 40 is formed in the closure 36 and that second slot 40 extends radially and perpendicularly relative to the slot 38 into alignment with an axially extending slot 42 in the peripheral walls 18; terminating at a position spaced from the web 22.

The male clasp member 14 is equipped with a detent 43 which extends forwardly from its socket wall 30 and includes a generally rectangular tongue 44 which is rooted in wall 30 and is defined by spaced apart side edges 46—46 and by a distal edge 48. A spring leaf 50 constituted by an integral distal extension of the tongue 44 is folded back from said free distal end 48 to resiliently overlie tongue 44 and is itself defined by spaced apart edges 52—52 and a free end 54. It will be noted that, in the embodiment illustrated, that the tongue 44 at least is essentially identical in width to slot 38. In its normal relaxed position, the leaf 50 extends angularly away from the tongue 44, but being formed of a resilient, spring material, it can be deflected to lie flatly against the tongue as herein explained. It is also noteworthy for reasons which will become apparent that leaf 50 is shorter than tongue 44, (between socket wall 30 and distal edge 48) by the thickness of end closure 36 so that, once the detent 43 enters compartment 20 to wall 30, the leaf 50 will be free to resume its angular posture relative to tongue 44.

The male clasp member 14 also comprises externally manipulable leaf-deflecting means in the form of an upstanding fin 56 for resiliently deflecting the leaf 50 toward the tongue 44 in a manner which will be more readily understood as the description herein proceeds.

Usefully, the clasp 12 may also include a secondary safety catch comprising a snap 58 pivoted at 60 on the peripheral wall 18 of the female clasp member 16 and a co-operating pin 62 on the wall 32 of the male clasp member 14.

In use, the male and female clasp members 14 and 16 respectively are secured to the band 10 as already considered. To secure the two clasp members 14 and 16 together, the distal edge 48 of the tongue 44 is first thrust through diametrically extending slot 38 in the closure 36 of the female clasp member 16. While transiting through the slot 38 leaf 50 will be cammed to deflect automatically as actually shown in FIG. 3; the upstanding fin 56 passing through the radially extending slot 40 and into the axially extending slot 42 until further axial movement of the male clasp member 14 is arrested by abutment of the wall 30 of the male clasp member 14 with the closure 36 as will be apparent from FIGS. 5 and 6. In such position, the free end 54 of the leaf 50, now disposed within the compartment 20 and being no longer contained in slot 38, will automatically spring back into the relaxed and re-expanded position shown in FIGS. 4, 5 and 6 in engagement with the closure 36. It will now be understood that the male clasp member 14 cannot be disengaged from the female clasp member 16 unless the outwardly projecting fin 56 is depressed to deflect the leaf 50 back to its collapsed position flat againt tongue 44. With the male and female clasp members 14 and 16 respectively interlocked in the aforesaid manner, the safety snap 58 can be releasably snapped over the pin 62 in an understood manner (not shown).

In this embodiment the female clasp member 16 is given a cylindrical conformation and, as has been emphasized, the slot 38 in its end closure 36 is located so as to straddle a diameter of the inner compartment 20 of female clasp member 16.

This ensures that the compartment 20 will narrow progressively in at least one direction which is angular to the slot 38.

In addition, the bias applied to spring leaf 50 is sufficient to raise it in the interior of compartment 20 to a level in which it wedges itself with some force between the narrowing walls 18 of compartment 20. Thus, when clasp members 14 and 16 are interlocked the tongue 44 remains relatively snugly ensconced in slot 38; the free end 54 of spring leaf 50 engages end closure wall 36 in the interior of compartment 20 while its side edges 52—52 engage the walls of compartment 20 as the spring leaf 50 becomes wedged between them, as seen in FIG. 4.

Essentially, retention of the clasp members 14 and 16 is effected by engagement of spring leaf end 54 with end closure wall 36. However, it will be appreciated that unrestrained wobbling of detent 43 in female clasp member 16 may well procure disengagement of these parts by inadvertent deflection of spring leaf 50.

The capacity of the detent 43 to wobble in the female clasp member 16 thus threatens the security of its interlock with the male member 14. Hence, restricting or inhibiting wobble of the detent 43 in female clasp member 16, mitigates this threat.

It may be acknowledged, of course, that the threat is reduced if the engagement between the free spring leaf end 54 with end closure wall 36 is reasonably wide. However, in a slender clasp as herein visualized such engagement cannot be very wide and the threat caused by wobbling increases accordingly.

Narrowing the walls of the female clasp member to permit wedging of the spring leaf 50 between them accordingly becomes a major element in enhancing the security of the interlock achievable between present male and female clasp members 14 and 16.

While the invention has hereinbefore been specifically described with reference to the particular embodiment thereof as shown in the accompanying drawings, it should be understood that numerous variations in and modifications of the described structure are possible within the scope of this invention. For example, while the compartment 20 of the female clasp member 16 has been described as having a right cylindrical configuration, it is equally possible for the compartment to have different configurations provided, of course, that it has a decreasing width in a direction angular to the slot 38 as described to permit wedging of the resiliently depressible leaf of the male clasp member between the peripheral walls 18.

The spring leaf 50 is proportioned and biased to become wedged between the walls 18 with its free end 54 abutting the inner surface of closure 36 and with the tongue 44 snugly fitted within closure slot 38.

In this same connection, it will be obvious that a principal function of web 22 is to limit penetration of the terminal 26 into the female clasp member 16 to avoid interference with detent 43 and, in view of this, does not necessarily require to be a solid member as shown.

Other possible variations and modifications within the scope of the following claims are obvious and need not be enumerated herein.

What we claim is:

1. Releasably interlockable male and female clasp members for a jewelry band having slender terminals to which said clasp members conform and are respectively attachable, said male clasp member comprising:

a wall;

a detent projecting axially from one side of said wall;

a tongue forming part of said detent;

a leaf with a free end constituted by a distal extension thereof folded to overlie said tongue in a normal angular posture relative thereto but being resiliently deflectible to lie flatly against said tongue;

said female clasp member comprising:

peripheral walls defining a slender tubular body with an internal compartment within which said detent is receivable, and a closure for said compartment having a narrow, elongated, slot straddling the compartment and extending substantially from one wall thereof to the opposite wall, said walls being mutually inclined progressively narrowing the compartment on one side, at least, of the said slot:

said detent being insertible into said compartment through said slot when the leaf is deflected to lie flatly against the tongue; said leaf being shorter than the tongue by the thickness of the compartment closure enabling it to pass wholly through the slot and being biased to recover its normal angular posture within the compartment; said tongue being generally the width of said slot and firmly ensconced therewithin and said leaf being generally the same width as said tongue end engaging the mutually inclined walls of the compartment under the bias aforesaid, inhibiting wobbling of the detent relative to the female clasp member; and externally manipulable means being provided for deflecting the leaf in the interior of the compartment to flatten it against the tongue enabling withdrawal of the detent for the compartment through said slot.

2. Clasp members as set forth in claim 1 wherein the means for deflecting the leaf in the interior of the compartment comprises a fin upstanding on said leaf and projecting through the peripheral walls;

aligned passageways being provided in said peripheral walls and in said compartment closure accomodating transit of the fin therethrough as the detent passes through the slot.

3. Clasp members as set forth in claim 1 wherein said compartment is cylindrical and the slot in the closure extends diametrically thereof.

4. Clasp members as set forth in claim 1 wherein the body of the female clasp member is intermediately partitioned defining the said compartment on one side thereof and a terminal socket on its other side.

5. Clasp members as set forth in claim 1 wherein the male member has a terminal socket on the side of the wall opposite to that from which the detent projects.

6. Clasp members as set forth in claim 2 wherein the compartment is cylindrical and the slot in the closure extends diametrically thereof.

7. Clasp members as set forth in claim 6 wherein the body of the female clasp member is intermediately partitioned defining the compartment on one side thereof and a terminal socket on its other side.

8. Clasp members as set forth in claim 7 wherein the male member has a terminal socket on the side of the wall opposite to that from which the detent projects.

* * * * *